United States Patent [19]

Krajicek et al.

[11] Patent Number: 4,817,653

[45] Date of Patent: Apr. 4, 1989

[54] TANK CLEANING, WATER WASHING ROBOT

[75] Inventors: Richard W. Krajicek, Houston, Tex.; Robert R. Cradeur, Sulphur, La.

[73] Assignee: Serv-Tech, Inc., Houston, Tex.

[21] Appl. No.: 147,237

[22] Filed: Jan. 22, 1988

[51] Int. Cl.[4] ..... B08B 3/02; B08B 9/08

[52] U.S. Cl. ..... 134/168 R; 134/181; 180/6.2; 239/227; 239/722; 901/1

[58] Field of Search ..... 134/167 R, 168 R, 172, 134/180, 181; 239/120, 172, 175, 227, 722; 901/1, 43; 180/6.2

[56] References Cited

U.S. PATENT DOCUMENTS

| | | | |
|---|---|---|---|
| 1,372,317 | 3/1921 | Saliger . | |
| 2,726,807 | 12/1955 | Lewis . | |
| 3,412,862 | 11/1968 | Chaplin . | |
| 3,448,742 | 6/1969 | Bender | 134/168 R X |
| 3,477,178 | 11/1969 | Hulbert, Jr. | 134/167 R X |
| 3,559,230 | 2/1971 | Ogle . | |
| 4,023,862 | 5/1977 | Gold | 299/14 |
| 4,141,374 | 2/1979 | McMahan | 134/168 R X |
| 4,154,680 | 5/1979 | Sommer | 15/1.7 X |
| 4,167,950 | 9/1979 | Schaefer et al. | 134/168 R X |
| 4,289,155 | 9/1981 | Sable | 134/167 R |
| 4,304,022 | 12/1981 | Sommer | 15/1.7 |
| 4,429,429 | 2/1984 | Altschul | 134/167 R X |
| 4,558,479 | 12/1985 | Greskovics et al. | 15/1.7 |

FOREIGN PATENT DOCUMENTS

| | | | |
|---|---|---|---|
| 57820 | 9/1967 | Fed. Rep. of Germany | 134/168 R |
| 1556946 | 12/1968 | France | 134/168 R |

*Primary Examiner*—Philip R. Coe

*Attorney, Agent, or Firm*—John R. Kirk, Jr.

[57] ABSTRACT

A water washing robot having features uniquely useful in cleaning the interior of oil storage tanks and which comprises components that can be independently moved inside a storage tank and conveniently assembled therein. The assembled robot comprises a frame, a positive displacement pump carried by the frame, an articulatable water washing nozzle detachably mounted on the frame for spraying water on the interior surfaces of a storage tank. The robot is hydraulically powered.

18 Claims, 7 Drawing Sheets

TANK CLEANING, WATER WASHING ROBOT

BACKGROUND OF THE INVENTION

1. Technical Field of the Invention

This invention relates to a mobile articulatable tank cleaning water washing robot. More particularly, this invention relates to a mobile articulatable water washing robot for cleaning the interior of hydrocarbon storage tanks of the type used in petroleum refiners and chemical plants for storing large volumes of hydrocarbon liquids. Still more particularly, this invention relates to a water washing robot comprising a frame having positive displacement water pump means mounted therein, robot articulation means disconnectably mounted on the frame and nozzled articulatable wash water jetting means disconnectably mountable on the frame so that the robot, in unassembled form, can be transported to the interior of an oil storage tank through an entryway adjacent the bottom thereof and assembled in the oil storage tank for use in cleaning the tank. Appropriate means are also provided for supplying water under pressure to the articulatable water washing means and for delivering hydraulic fluid under pressure to hydraulic power means for the robot articulation means, the articulatable water jetting means and the positive displacement water pump means. Hydraulic control means interconnectable with the robot and hydraulic power means are also provided in order to control the movement of the robot and the water washing action thereof.

2. Prior Art

It is a known practice to use submerged robots for cleaning the surfaces of a swimming pool. Robots of this nature may be designed for remote control by an operator as shown, for example, by Sommer, U.S. Pat. No. 4,154,680 or for random travel during cleaning action as shown, for example, by Greskovics et al, U.S. Pat. No. 4,558,479. Other examples of swimming pool cleaning devices include those disclosed in Sable, U.S. Pat. No. 4,289,155, second Sommer patent, U.S. Pat. No. 4,304,022 and Altschul, U.S. Pat. No. 4,429,429.

Hydraulic powered remotely controlled robots have also been used in mining operations as shown, for example, by Salinger U.S. Pat. No. 1,372,317 and Gold U.S. Pat. No. 4,023,862.

However, insofar as Applicant is aware, hydraulically powered, remiotely controlled articulatable robots for cleaning large hydrocarbon storage tanks have not heretofore been proposed by those skilled in the art of hydrocarbon storage tank cleaning.

Prior Art Practice

Petroleum refineries, chemical plants, petroleum and chemical stock farms, etc. are normally provided with large cylindrical storage tanks having diameters of from about 20 to about 300 feet and heights of from about 50 to about 100 feet and closed to the atmosphere by floating or fixed roofs. With the passage of time and particularly when the tanks are used to store crude oil, sedimentation and fouling of the tank surfaces will occur. It then becomes necessary to empty the tank and to wash the tank free from fouling deposits and sediment. Even when the tank is essentially empty of stored hydrocarbons, sufficient quantities will remain to contaminate the air space with hydrocarbon vapors, which may be carcinogous. Also, the interior of the tanks can become uncomfortably hot, especially in summer, reaching temperatures as high as 125° F. Accordingly, the presence of highly polluted air and hot vaporized hydrocarbons or chemicals inside the tank, coupled with the ever present danger of fire or explosion, make the cleaning of such tanks both difficult and dangerous.

Conventionally, a gang of workmen enter the tank through an entryway adjacent the bottom thereof and manually operate high pressure hoses, similar to the hoses used in fighting fire, in order to wash down the inside of the tank and use suction lines at the bottom of the tank for removing wash water and sediments. It is normally necessary for the workmen to use respirators and it is frequently necessary for them to also wear protective garments to protect the skin and face of the worker. As a consequence, a workman can work inside the tank for only a very limited period of time because of the debilitating working conditions, and must then leave the tank to rest.

Typically, a workman may be able to work within the tank, especially during summer months in semitropical or tropical climates for not more than about 15 to about 30 minutes and must then rest and recuperate for about one hour or more before re-entering the tank. Moreover, since the hoses for cleaning purposes are manually operated, the water pressure in the hose cannot be so high as to unduly endanger the workman. Even so, if a workman accidentally loses control of a hose, its uncontrolled whiplashing movement can cause serious injury to workers in the work gang inside the tank because of the confined nature of the work place.

SUMMARY OF THE INVENTION

This invention is directed to an essentially self-contained mobile water washing robot which is remotely operable so that there is no need for operating personnel to be in close proximity to the cleaning nozzles or other high pressure lines during cleaning operations. As a consequence, signficantly higher water pressures and significantly higher water flow rates can be utilized with safety to thereby not only accelerate the rate of cleaning but also the efficiency and the effectiveness of the cleaning operation. It is possible to adjust the position of the nozzle head by articulation in order to clean the bottom, all the side surfaces and even the top of the tank, if necessary. Moreover, only one operator is required inside the storage tank to control the operation of the robot, and he is not involved in heavy manual labor so the time that he can safely spend within the confined cleaning space may be significantly lengthened.

DESCRIPTION OF THE INVENTION

In accordance with the present invention, an articulatable, remotely controlled, hydraulically powered water washing robot is provided which can be disassembled, moved into a storage tank to be cleaned through an entryway adjacent the bottom thereof, and then assembled therein for water washing purposes.

In accordance with the present invention, the principle components of the robot include an opened bottom frame in which a hydraulically powered positive displacement water pump is mounted for pumping sediments and spent wash water from the storage tank. Also included are hydraulically powered and hydraulically operated robot articulation means for articulating the frame such as a pair of independently operable disconnectable caterpillar treads, a hydraulically powered and operated articulatable water washing means disconnectably mountable on the frame and remotely controllable hydraulic control means hydraulically interconnected with the robot for powering and controlling the operation of the robot. A portable power unit is preferably provided outside of the storage tank which comprises suitable means such as a high pressure water pump which is interconnected by hoses with a water source and the robot for supplying wash water to the robot. Also, a hydraulic pump connected with a hydraulic reservoir is provided for supplying hydraulic fluid under pressure through hydraulic flow lines interconnecting the hydraulic pump with the hydraulic fluid reservoir and the robot for supplying the hydraulic fluid for operation and control of the robot.

In a preferred embodiment of the present invention, the water washing robot will comprise an open bottomed frame, having hydraulically powered robot articulation means removably mounted thereon for moving the frame about the bottom of a tank to be cleaned. Reverse action hydraulically powered positive displacement water pump means are mounted on the frame for normally pumping spent wash water and sediments from the tank being cleaned, including hydraulic pump motor means carried by the frame and operatively connected with the reverse action positive displacement water pump for operating the pump and for reversing the direction of flow, when necessary, as hereinafter described in greater detail. Nozzled hydraulically powered articulatable water washing means are mounted on the frame for spraying water onto the interior surfaces of the tank in order to clean the same. Hydraulic motor means are provided for independently powering the robot articulation means and the nozzled articulatable water washing means carried by said frame and hydraulic control means are also provided which are remote from and hydraulically operatively interconnected with the hydraulic motor means for controlling the action of the hydraulic motor means and the positive displacement water pump.

The entryway to a storage tank is normally circular in cross-section and will typically have a diameter of about 15 to about 36 inches. Therefore, only items of equipment having comparatively small dimensions can be moved into the tank through the entryway. A robot small enough to be transported into the tank as an assembled unit would be so small that the cleaning efficiency would be significantly impaired. Therefore, in accordance with the preferred embodiment of the present invention, a robot is provided which comprises disconnectable components, each of which can be moved through the entryway into the interior of the tank to be cleaned for convenient assembly therein.

In accordance with the most preferred embodiment, the present invention comprises the following components:

(a) An open bottomed frame which can be transported through the entryway and which has mounted therein a reverse action, positive displacement water pump means, a hydraulic motor for powering the water pump means, a scoop-shaped inlet mounted to the bottom inlet port of the positive displacement pump means, a filter mounted across the face of the scoop-shaped inlet to prevent unpumpable sediments and solids from fouling or damaging the pump. A pair of hydraulic motors for reversibly powering the robot articulation means are also mounted on the frame.

(b) Robot articulation means such as a pair of articulation frames are detachably mounted on opposite sides of the robot frame, each of the articulation frames having an idler spool rotatably mounted adjacent one end thereof, a hydraulically powered drive spool rotatably mounted on the articulation frame adjacent the other end thereof, and a caterpillar tread elliptically interconnecting the idler spool and the drive spool for moving the robot.

(c) Washing water jetting means are provided comprising a water jet frame transportable through the entryway and releasably mountable on the top of the robot frame, the water jet frame having a water pipe vertically mounted thereon, a first hydraulically powered horizontally rotatable elbow joint rotatably mounted on the top of the water pipe, a second hydraulically powered vertically rotatable elbow rotatably mounted on the free end of the first elbow joint and a nozzled discharge conduit mounted on the free end of the second elbow joint.

Suitable water supply means are also provided which may be mounted on the robot frame and operatively interconnected with the vertical water pipe.

A remotely operable hydraulic control means is provided which is hydraulically operatively interconnected to suitable hydraulic power means mounted on the robot means such as hydraulic pumps for powering the positive displacement water pump means, the robot articulation means and the first and second rotatable elbow joints, each being operable independently of the other.

Since storage tanks are frequently located in areas that are remote from a power supply, in accordance with the preferred embodiment of the present invention, a portable power unit is provided for location adjacent to and outside of the storage tank to be cleaned. The portable power unit will suitably comprise an independently operable prime mover such as a diesel engine or a gasoline powered internal combustion engine, and appropriate drive means interconnecting the prime mover with a high pressure water pump and a hydraulic pump mounted on the power unit. In accordance with the present invention, the inlet to the high pressure water pump is interconnected by a water supply hose with an appropriate water source and the outlet from the high pressure water pump is interconnected with a water inlet on the articulatable water jetting means by a water charge hose that passes from the high pressure pump through the entryway into the storage tank. Similarly, the hydraulic pump is interconnected in a hydraulic circuit with a hydraulic fluid reservoir which is preferably carried on the power unit and interconnected with the hydraulic motors for driving the positive displacement pump, the robot articulation means and the articulatable nozzled wash water jetting means, this being accomplished through the provision of appropriate hydraulic lines, as hereafter described in greater detail. The hydraulic control means is hydraulically operatively interconnected with the hydraulic pump and the hydraulic motors in a manner to be described.

With this construction, the robot, in unassembled condition, can be transported to a storage tank to be cleaned, and, when the storage tank is substantially empty of fluids, the components of the robot can be moved into the inside of the tank through an entryway and rapidly assembled therein and then connected by appropriate water hoses and hydraulic lines with the portable power unit outside the tank.

The open bottomed frame and the associated equipment mounted therein including the positive displacement water pump means are compact, but comparatively massive and difficult to manually handle, particularly when it is necessary to move the assembled frame and positive displacement pump means through the entryway. Accordingly, a portable, adjustable scaffolded, trackway and wench assembly is preferably provided to assist in moving at least the assembled open bottomed frame through the entryway.

At the beginning of the cleaning operation, there still may be a significant quantity of liquids and sediments such as hydrocarbons, water, sludge, etc. at the bottom of the tank which must be removed. This can be conveniently accomplished by energizing the positive displacement water pump so that the residual liquids and sediments are drawn through the filter and the scoop and positively pumped from the tank through a pump discharge hose passing through the entryway. If the filter becomes clogged so that the pump is starved for fluid, the operator can temporarily reverse the direction of flow of the pump in order to clear the filter and then return the pump to normal operation.

When the storage tank is substantially dry, the articulatable nozzled water washing mean can be connected with the water pump outside of the storage tank by means of a charge hose passing from the pump through the entryway and connected to the robot.

An operator, appropriately protected against the environment on the inside of the tank by a respirator and, if necessary, protective clothing, can then enter the tank, energize the nozzled water washing means with the control panel and progressively wash down the sides of the tank. Accumulated spent wash water will be pumped from the bottom of the tank by the positive displacement pump in a manner to be described.

Since it is not necessary for the operator to physically handle the water washing means, water under particularly high pressures, such as pressures of about 10,000 psig or more can be provided at comparatively high flow rates such as flow rates of about 100 gallons per minute or more.

As a consequence, the high volume, high pressure stream of water that emanates from the robot in a manner controlled by the operator can be used to more quickly and more effectively clean the inside of the tank than has heretofore been possible.

DESCRIPTION OF THE DRAWINGS

In the Drawings:

Turning now to FIG. 1, there is schematically shown an oil storage tank 10 having an entryway 12 through which has been moved an assembled tank cleaning water washing robot, indicated generally by the numeral 100. The assembled tank cleaning water washing robot 100 comprises, generally, a water washing robot frame assembly 200, and an articulatable wash water jetting means 300 removably mounted on the top of the water washing frame assembly 200.

Figure 1:
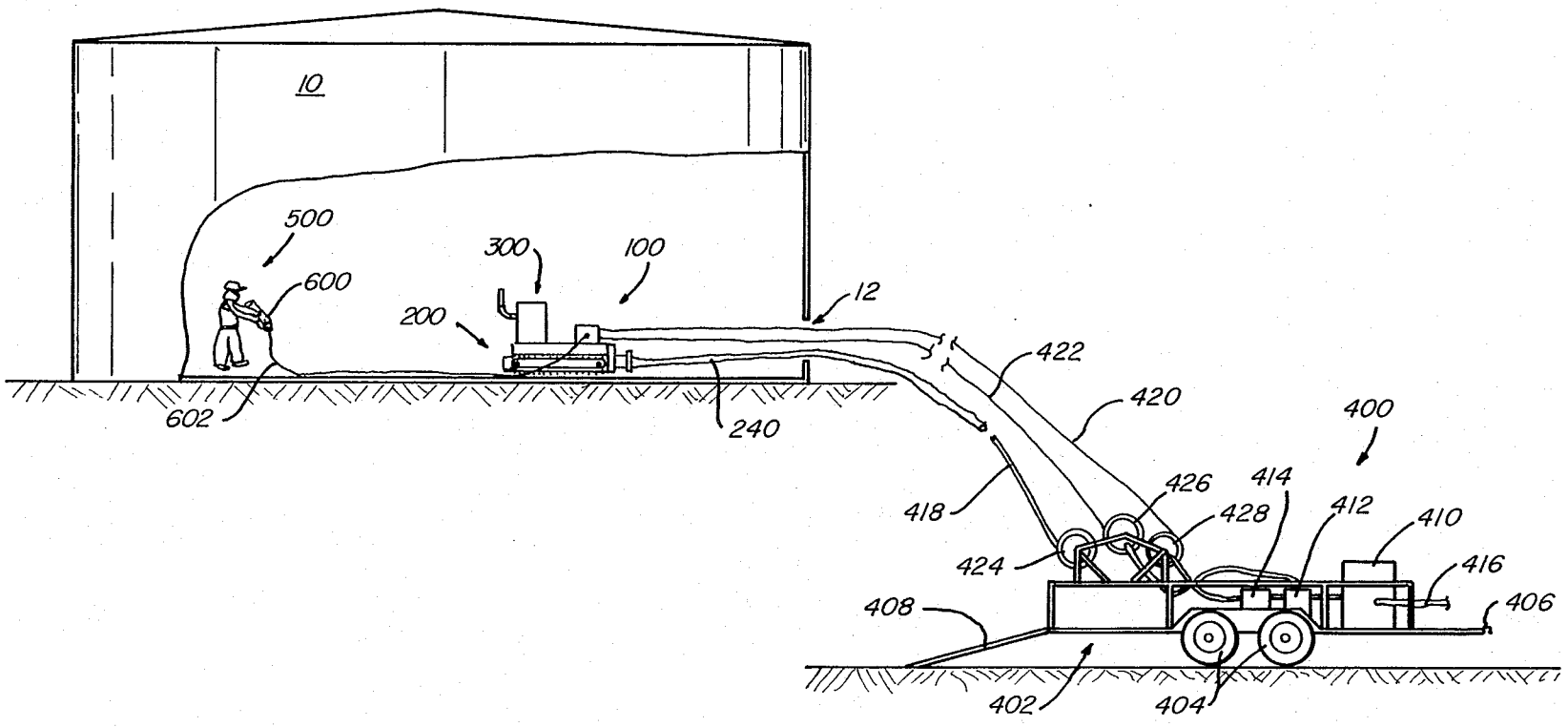
FIG. 1 is a side elevational assembly view, with parts of a storage tank broken away, showing the interconnection of the assembled water washing robot with the portable power unit and also the manner in which a workman operates the robot in order to clean an oil storage tank.

In accordance with a preferred embodiment of the invention a portable power unit generally designated by the number 400 is also provided outside of the storage tank 10. The portable power unit will comprise conventional equipment known to those skilled in the art and will be mounted on an appropriate movable support means of conventional construction such as a truck, a trailer towable by a truck, skids, etc. The portable power unit 400 that is shown may suitably comprise, for example, an appropriate body portion 402 of a trailer supported on wheels 404 and provided with a trailer hitch 406 for towing and moving.

The body portion 402 may also be suitably provided with a tailgate 408 providing ready access to the main body of the unit. Mounted on the body portion 402 are a high pressure water pump 410, of any suitable construction operatively interconnected by an appropriate conventional power train and transmission (not shown) to a hydraulic pump 412 which, in turn, is hydraulically interconnected with a hydraulic fluid reservoir 414. A water supply hose 416 leads from an appropriate water source (not shown) to the inlet for the high pressure water pump 410 and a water discharge hose 418 leads from the outlet of the high pressure pump 410 in a manner to be described. Also supported on the body portion 402 are a water discharge hose reel 424 about which the water discharge hose 418 may be coiled for transportation purposes, a hydraulic fluid supply hose reel 426 and a hydraulic fluid return hose reel 428 are also provided. A hydraulic fluid supply cable 420 leading from the hydraulic pump 412 passes through the entryway 12 and is interconnected with the assembled tank cleaning water washing robot 100 as is a hydraulic fluid return cable 422 so that hydraulic fluid may flow (in a manner to be described) to and from the hydraulic components of the assembled tank cleaning water washing robot 100.

A workman designated generally by the number 500, and appropriately protectively garbed with a respirator and protective clothing, as needed, is stationed in the tank 10 and operates a hydraulic control unit 600 interconnected with the assembled tank cleaning water washing robot 100 by a control unit hydraulic cable 602 and while standing in a position remote from the assembled tank cleaning water washing robot 100 controls movement of the robot frame assembly 200 and of the articulatable wash water jetting means 300 so that the tank cleaning operation can be appropriately conducted in a manner to be described.

Figure 2:
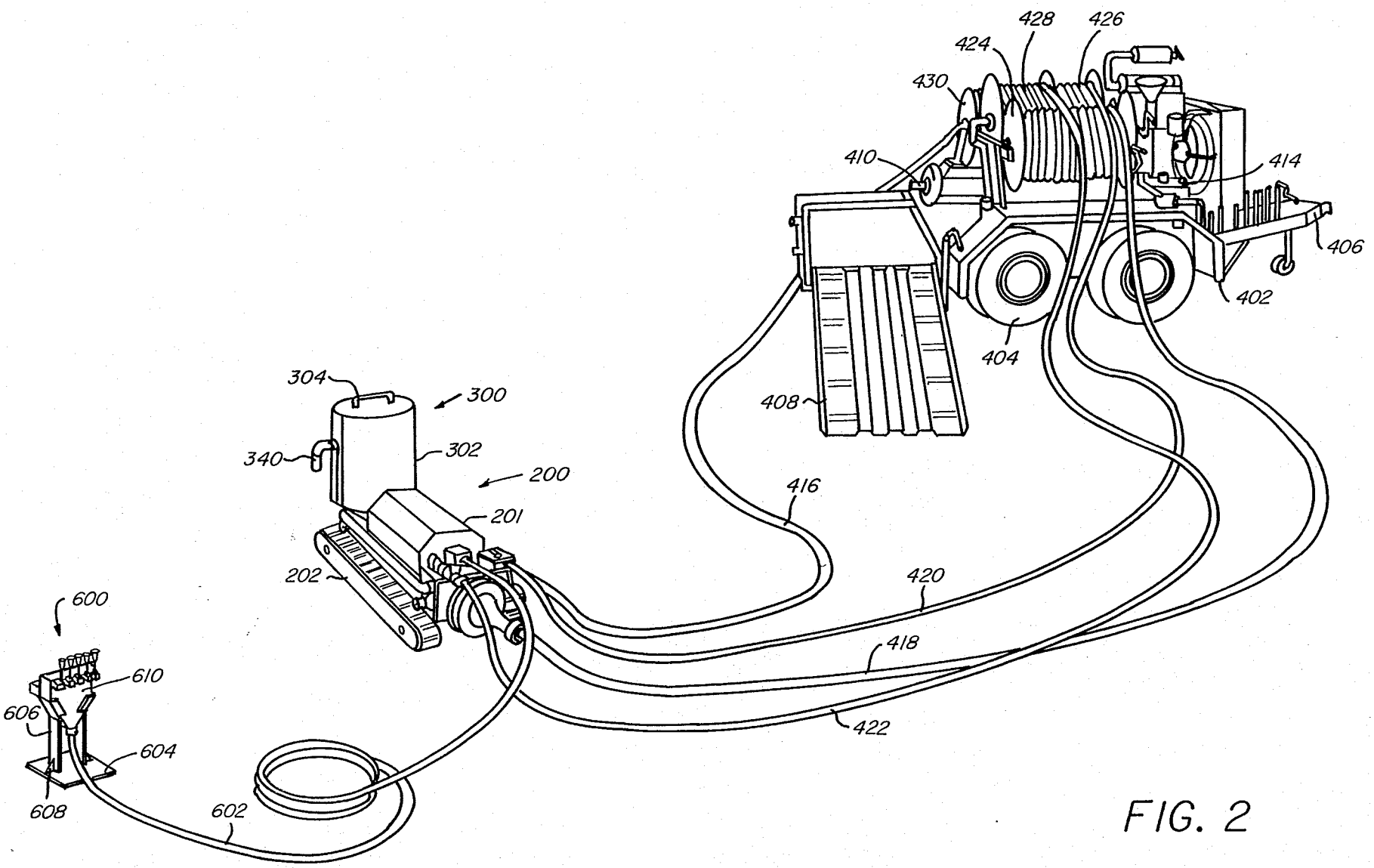
FIG. 2 is a perspective view of the water washing robot, the hydraulic control means and the portable power unit showing the assembled inter-connections of the units.

Turning now to FIG. 2, it will be seen that the assembled tank cleaning water washing robot 100 has the articulatable water wash jetting means 300 mounted on the top thereof and protected from water by an open bottomed cover 302. A removable bonnet 201 is provided to cover the top of the water wash robot frame assembly 200 so that the water washing robot frame assembly 200 and the articulatable water wash jetting means 300 can be protected from water spray during washing operations. The protective covers are not an essential feature of the present invention but are a desirable feature to prolong the working life of the protective elements. Nozzle 340 projects from the open bottomed cover 302 for the discharge of water during cleaning operations.

A hydraulic control unit 600 is interconnected with the water washing robot frame assembly 200 by means of a control unit hydraulic cable 602. Water under pressure discharged from the high pressure water pump 410 on the portable power unit 400 is fed to the water washing robot frame assembly by means of a water supply hose 416 in a manner to be more fully described hereinafter, and spent water is discharged from the water washing robot frame assembly 200 for disposal in any appropriate manner by way of a water discharge hose 418. Hydraulic fluid under pressure is charged to the water washing robot frame assembly 200 from the hydraulic reservoir 414 by means of a hydraulic pump 412 of any suitable conventional construction and hydraulic fluid supply cable 420. Low pressure hydraulic fluid is returned to the hydraulic reservoir 414 by way of low pressure hydraulic fluid return cable 422.

Turning next to FIGS. 4–7, there is shown an open bottomed frame 203 (FIG. 6) defined by a top panel 202, side panels 204 and 206, front panel 208 and rear panel 210. Cross brace panels 212, 214 and 216 are provided in order to increase the strngth and structural integrity of the frame 203.

In the illustrated preferred embodiment, a water wash inlet pipe 250 which is preferably threaded at the inlet end thereof for convenient interconnection with the water supply hose 416 is mounted to the side of the side panel 206 and is provided with a first "L" shaped inlet pipe extension 252 which is preferably disposed in a generally horizontal plane and also with a second "L" shaped pipe extension 254 which preferably is disposed in a generally vertical plane for interconnection with the articulatable water washing jet means by a pipe union 258 having a threaded end. The water washing inlet pipe 250 can also function as a handle or means for carrying or supporting the water washing robot frame assembly 200 and, in accordance with the preferred embodiment of the present invention, a handle pipe 256 of a corresponding construction is similarly mounted to the side panel 204 to facilitate hoisting and movement of the water washing robot frame assembly 200.

Figure 11:
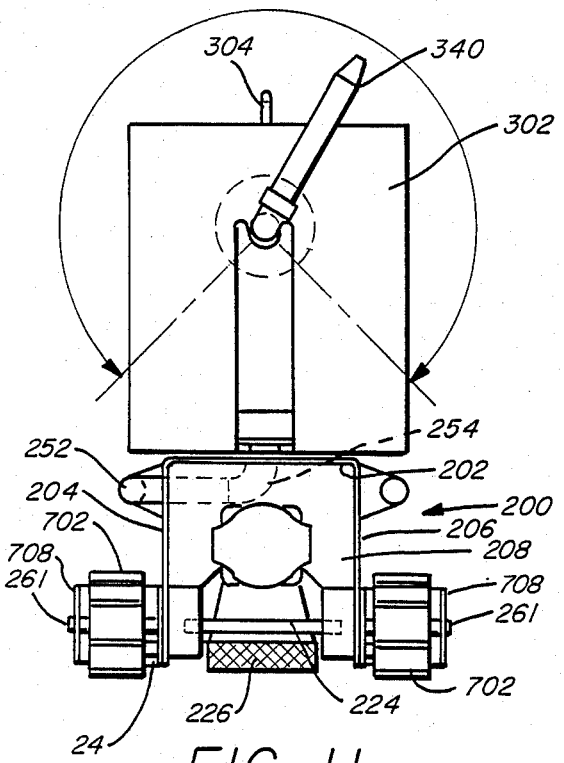
FIG. 11 is a front elevational view of the articulatable water jetting means shown in FIG. 8.

Appropriate robot articulation means 700 of any desired construction (FIGS. 11–13) are provided for supporting the assembled tank cleaning water washing robot frame assembly 100. This may be accomplished, for example, by providing a tubular tread pipe support 260 (FIGS. 4–7) mounted adjacent each of the lower quadrants of the frame 203 on the panels 204 and 206. A tubular tread support pipe 262 is releasably mounted in each of the tubular tread pipe supports 260 for assembly with the robot articulation means 700 in a manner to be described.

Hydraulic motors 280 and 282 are mounted in circular openings adjacent the bottoms of each of the side panels 204 and 206 to provide a source of hydraulic power for reversibly driving the hydraulic powered robot articulation means 700 and are interconnected therewith in a manner that will be described by means of drive shafts 284 and 286.

Also in accordance with the preferred embodiment of the present invention, and in order to facilitate movement of the water washing robot frame assembly 200 through an entryway 12 into a storage tank, a first pair of idler rollers 270 and a second pair of idler rollers 272 are mounted to each of the side panels 204 and 206 in any appropriate manner. For example, a first pair of bearings 276, and a second pair of bearings 278 may be suitably attached to the side panels 204 and 206 such as by welding, and idler roller pairs 270 and 272 may be journaled in the bearing journal pairs 276 to 278 for free rolling movement. Each of the idler rollers of pairs 270 and 272 is preferably provided with a concave roller bearing surface matching the guide rails 810 and 812 (FIG. 3) of the scaffolded/slide rail/wench assembly 800 to be hereinafter described in greater detail.

Figure 8:
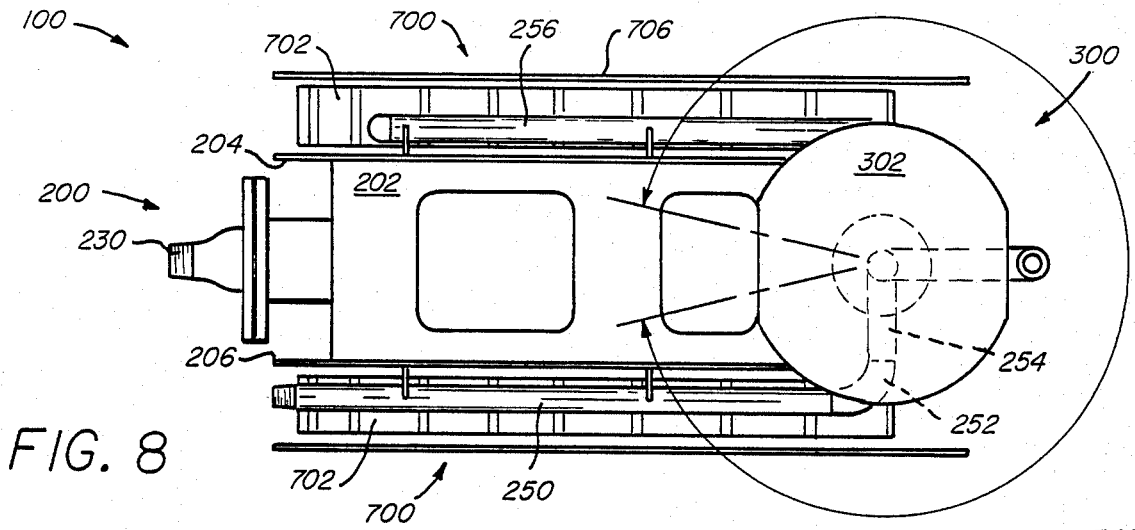
FIG. 8 is a top view of the assembled water washing robot shown.
Figure 9:
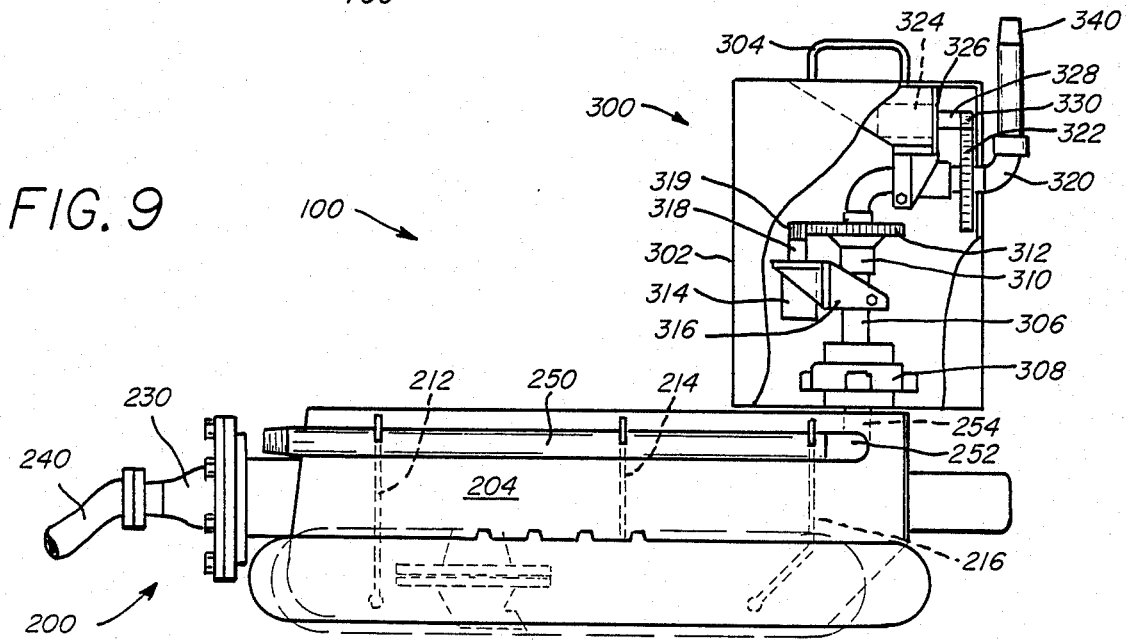
FIG. 9 is a side elevational view, with parts broken away, of the assembled water washing robot shown in FIG. 8.
Figure 10:
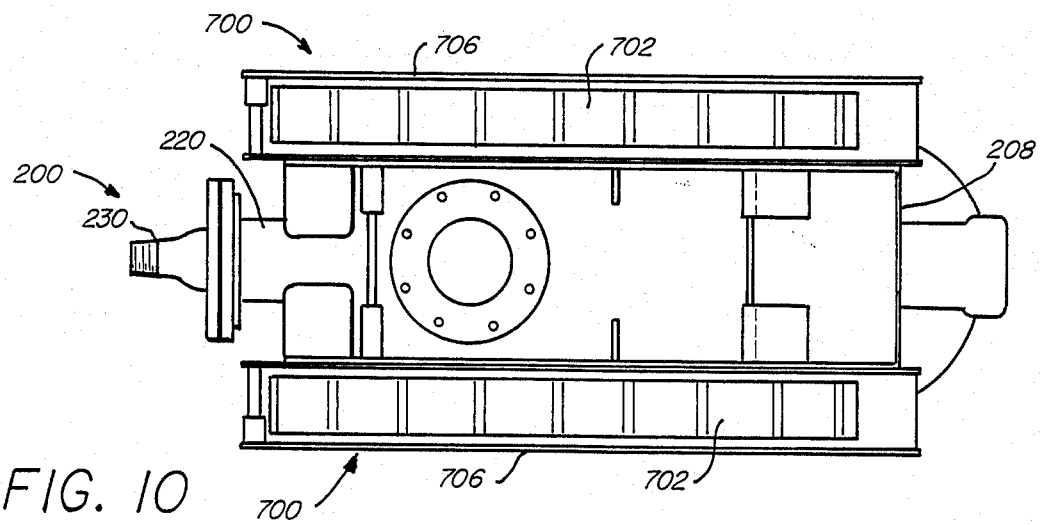
FIG. 10 is a bottom view of the assembled water washing robot shown in FIG. 8.

In FIGS. 8–10 the assembled tank cleaning water washing robot 100 is shown in greater detail, and, as indicated, comprises a water washing robot frame assembly 200, the articulatable wash water jetting means 300, and hydraulically powered robot articulation means 700 of any desired construction such as a pair of rubber caterpillar treads 702.

Figure 14:
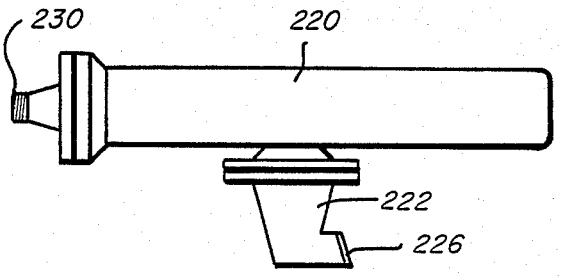
FIG. 14 is a schematic side elevational view of the positive displacement water pump means.

A water pump of any desired construction, which is preferably a hydraulically powered positive displacement pump such as a moyno pump 220 (FIG. 14) is mounted inside of the water washing robot frame assembly 200 and secured to the front panel 208, the rear panel 210 and the cross panels 212, 214 and 216 in any suitable manner (not shown). As is shown more clearly in FIG. 14, the pump 220 is provided with a flanged, scoop shaped inlet port 222. A filter 226 is mounted across the opening of the flanged inlet port 222 to prevent solid materials from being drawn into the pump 220. The discharge port of the positive displacement pump 220 is provided with a flanged outlet port adapter 230 to which the spent wash water discharge hose 418 is releasably secured, as shown more clearly in FIG. 8.

Returning now to FIGS. 8–11 and 13, the articulatable wash water jetting means 300 that is mounted to the top panel 202 adjacent the front end thereof may be constructed in a suitable manner of components which will comprise a nozzled water discharge conduit, means for rotating the conduit in both a horizontal and a vertical direction, means for securing the wash water jetting means 300 to the top panel 202 and means for interconnecting the water discharge conduit with the inlet pipe 250. A preferred embodiment, which is shown more clearly in FIGS. 9, 11 and 13, comprises an open bottomed cover 302 having a carrying handle 304 fixed to the top thereof. The vertical pipe 306 is connected with a pipe union 308 which is mounted on pipe union 258 by any appropriate means such as a hammer nut coupling 309. A first swivel joint 310 is mounted to the top of the vertical pipe 306 in order to permit rotation of the articulatable wash water jetting means 300 in a horizontal direction. To this end a first swivel joint gear (FIG. 13) 312 is fixed to the first swivel joint 310 and a hydraulic motor 314 is mounted on a hydraulic motor bracket 316 carried by the vertical pipe 306. The hydraulic motor 314 is provided with a drive shaft 318 having a pinion gear 319 that mates with and drives the first swivel joint gear 312.

A second swivel joint 320 is mounted to the top of the first swivel joint 310 and is provided with a second swivel joint gear 322. It will be noted that the second swivel joint 320 and the associated second swivel gear 322 permit rotation of the second swivel joint in a vertical plane. This is accomplished by means of a hydraulic motor 324 fixed to the second swivel joint 320 by a hydraulic motor bracket 326. Hydraulic motor 324 is provided with a drive shaft 328 and a pinion gear 330 that meshes with the second swivel gear 322.

A nozzle 340 is threaded to the outlet of the second swivel joint 320. As is shown more clearly in FIG. 8, with this construction the articulatable water wash jetting means 300 can rotate about one hundred seventy degrees in either direction in a horizontal plane, and is shown more clearly in FIG. 11, the articulatable water wash jetting means 300 can be rotated such that the nozzle 340 rotates about one hundred thirty-five degrees in either direction from the vertical.

Figure 6:
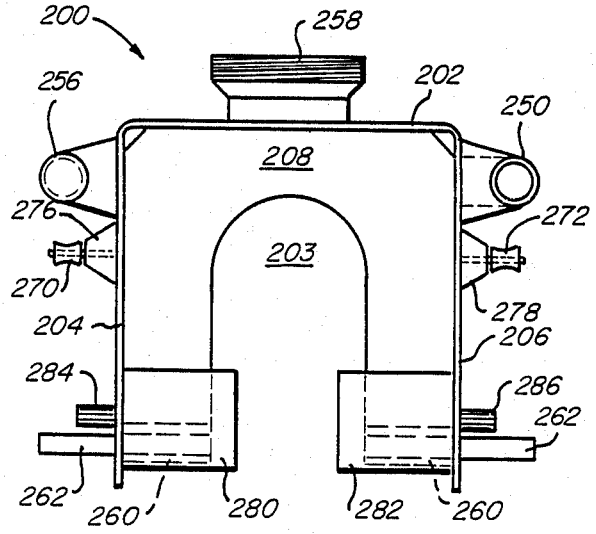
FIG. 6 is a front view of the frame shown in FIG. 4.
Figure 7:
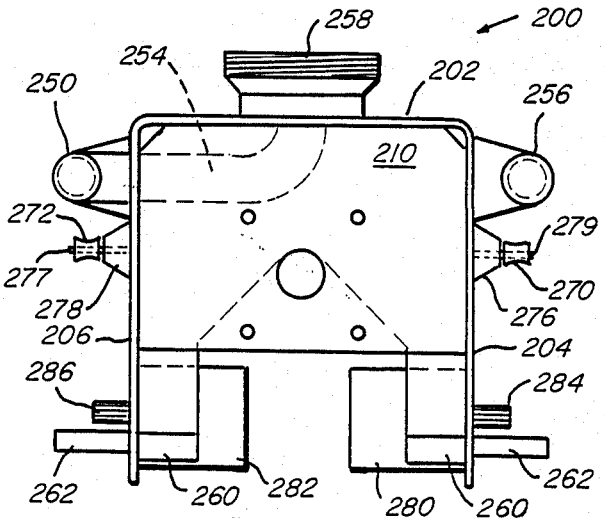
FIG. 7 is a rear view of the frame shown in FIG. 4.

Turning now to FIGS. 8–10, the hydraulically powered robot articulation means designated generally by the numeral 700 comprises a pair of caterpillar treads, such as a rubberized tractor treads 702, mounted on a caterpillar tread frame 708 of any suitable construction and are operatively interconnected in any suitable manner with the drive shafts 284 and 286. Each of the caterpillar treads 702 is mounted on the open bottomed frame member 203 by tubular tread supports pipes 262 (FIGS. 6 and 7).

Turning next to FIG. 2, the control panel 600 may comprise, for example, a base plate 604 to which a pair of upstanding brackets 606 are affixed by any suitable means such as braces 608. The hydraulic control panel 600 comprises a cover 610 for a block (not shown) into which fittings are journaled for the hydraulic lines comprised in the control cable 602 and a toggle switch operatively interconnected with toggle control valves 951, 953, 955, 957 and 959 (FIG. 12) by individual hydraulic lines, as schematically shown in FIG. 12.

Figure 12:
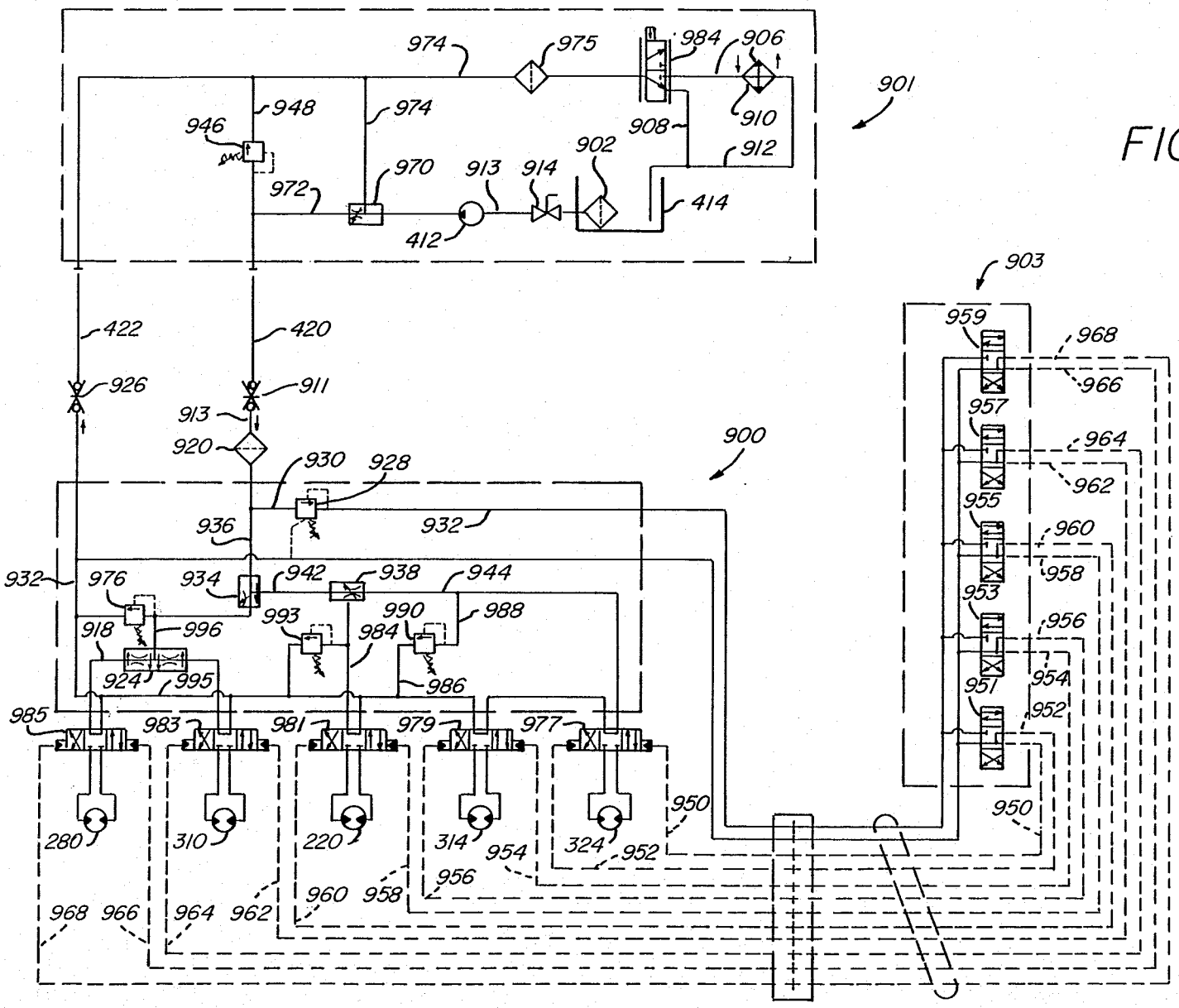
FIG. 12 is a schematic layout of the hydraulic system of the preferred embodiment of the present invention.
Figure 13:
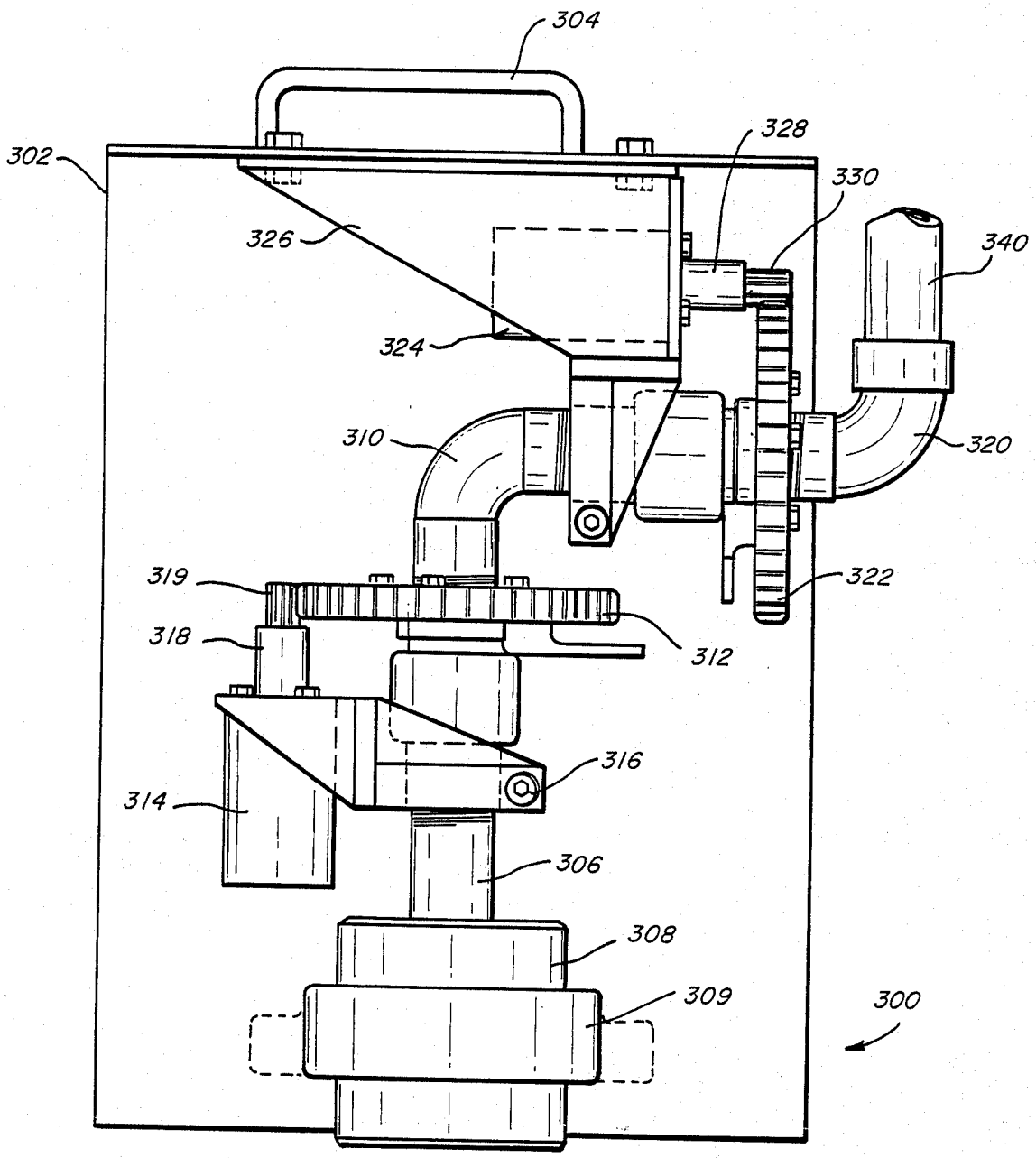
FIG. 13 is a side elevation and view of the assembled water washing robot shown in FIG. 8, to an enlarged scale, with parts having the articulatable broken away, of the articulatable water jetting means shown in FIG. 9.

Turning now to FIG. 12, there is diagramatically disclosed, the hydraulic control circuit and operating circuit of the present invention in one of its preferred embodiments.

In FIG. 12, the reference numeral 900 indicates an integrated circuit board which is mounted on top panel 202, reference numeral 901 designates the hydraulic equipment mounted on the portable power unit 400 and reference numeral 903 designates the hydraulic switches on the hydraulic control unit 600. Thus, for example, a hydraulic reservoir indicated by the reference numeral 414 is mounted on the portable power unit 400 and a hydraulic pump 412 is interconnected therewith by a flow line 913 containing a butterfly shutoff valve 914. The flow line 918 terminates inside the reservoir 414 and is suitably provided with a suction filter, designated generally by the numeral 902. Hydraulic fluid withdrawn from the reservoir 414 by the hydraulic pump 412 is charged to a flow regulator valve 970 having a discharge line 972 leading to hydraulic hose 420 and a recycle line 974 leading through a filter 975 to a thermostatic control valve 904 which discharges by a line 906 to a heat exchanger 910 and from thence by a recycle line 912 to the reservoir 414. A portion of the hydraulic fluid charged to the thermostatic control value 904 may be directly charged to the recycle line 912 by way of a line 908. A return hose 422 also leads to the line 974. A bridging line 948 contains a pressure relief valve 946 which interconnects with the lines 972 and 974.

The hose 420 interconnects to a quick disconnect check valve coupling 911 with a line 913 leading to a filter 920 and from thence by way of line 922 to a bypass restricting combination flow regulator valve 934 by way of line 936 and a pressure reducing valve 928 by way of a line 930. A discharge line 932 leads from pressure reducing valve 928 to the operator control manifold 903, hereinafter described in greater detail. Hydraulic fluid may flow from flow regulator combination bypass restricting valve 934 through a line 942 to secondary combination flow regulator bypass reaction valve 938 with a branch line 944 leading to a three way directional control valve 977. Hydraulic fluid can then continue to flow from directional control valve 977 in series through directional control valve 979, directional control valve 981, directional control valve 983 and directional control valve 985.

After flowing through three way directional valve 985, the hydraulic fluid returns by line 932 through quick valve disconnect check valve 926 to interconnect with hydraulic hose 42.

The branch line 995 interconnects three way valve 983 with three way valve 985 by way of a flow divider valve 924 so that the valves 983 and 985 can be operated for flow in opposite directions.

A branch line 996 leads from flow divider valve 994 to a pressure relief valve 976. Branch line 978 returns from a pressure relief valve 976 to line 932 and branch line 980 leads to the bypass reactive flow regulator combination valve 934 described above. A branch line 984 also leads from three way directional valve 981 to a second pressure relief valve 993 which interconnect with line 932 by way of branch line 980 and with the flow regulator combination bypass restriction valve 938 by way of a flow line 992.

A branch line 986 leads from the line 932 to a third pressure relief valve 990 which is provided with a line 988 returning to the line 994.

The three way directional control valves 977, 979, 981, 983 and 985 are connected with hydraulic motor 280, motor 310, the hydraulic motor for pump 220, motor 314 and motor 324.

The positioning of the hydraulic valves 977, 979, 981, 983 and 985 is regulated by manifold control three way directional control valves 951, 953, 955, 957 and 959 mounted on the operator control manifold 903. To this end, the control cable 602 provides a housing for hydraulic control line 950, 952, 954, 956, 958, 960, 962, 964, 966 and 968, interconnecting the hydraulic controls for the three way hydraulic valves 977, 979, 981, 983 and 985 with the three way toggle valves 951, 953, 957 and 959 For example, the three way directional control valve 975 is interconnected with the toggle valve 951 by way of control lines 950 and 952. Movement of the toggle switch (not shown) from the neutral position will cause hydraulic fluid to flow between the valve 951 and the valve 975. If the toggle switch is moved forward, for example, the valve 975 will be energized to permit hydraulic fluid to flow through the valve 975 to the motor 324 for clockwise rotation of the motor 280. Reversing the direction of the toggle switch of the valve 975 will cause a corresponding reversal in the direction of flow of hydraulic fluid through the lines 950–952 and, likewise, a corresponding reversal of the flow of hydraulic fluid through the hydraulic motor 324 so that is will rotate in a counterclockwise direction. Three way directional control valve 979, 981, 983 and 985 are similarly regulated by toggle control valves 951, 953, 955 957 and 959.

Figure 3:
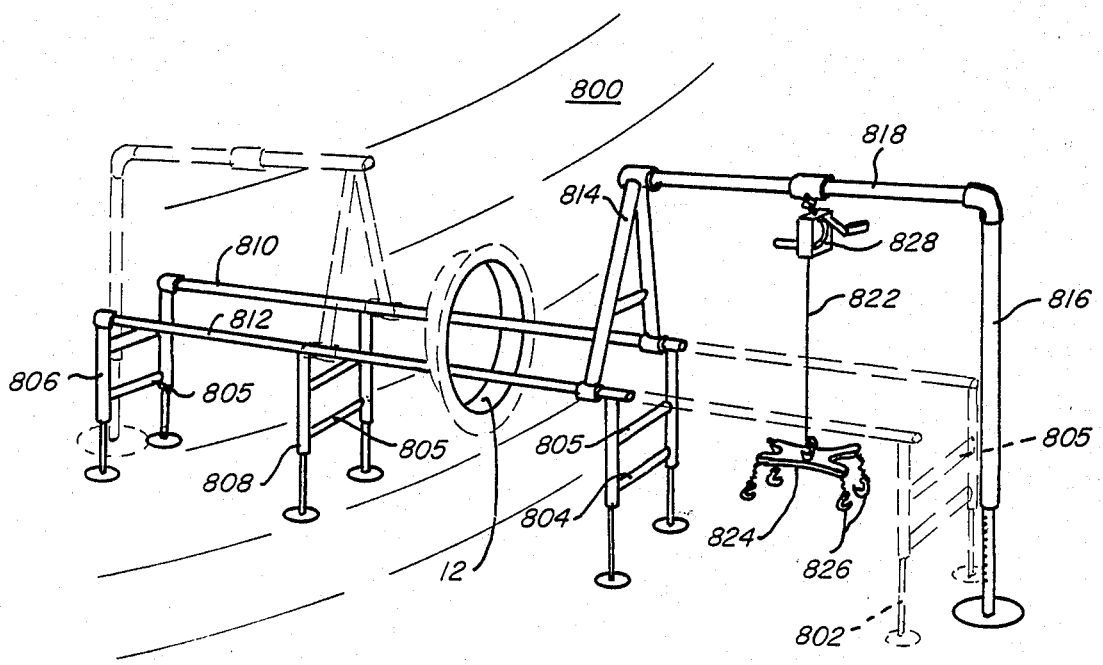
FIG. 3 is a perspective view showing the construction of a portable scaffolding, slide rail and wrench assembly for use in moving the assembled open bottomed frame through an entryway into a storage tank to be cleaned.
Figure 4:
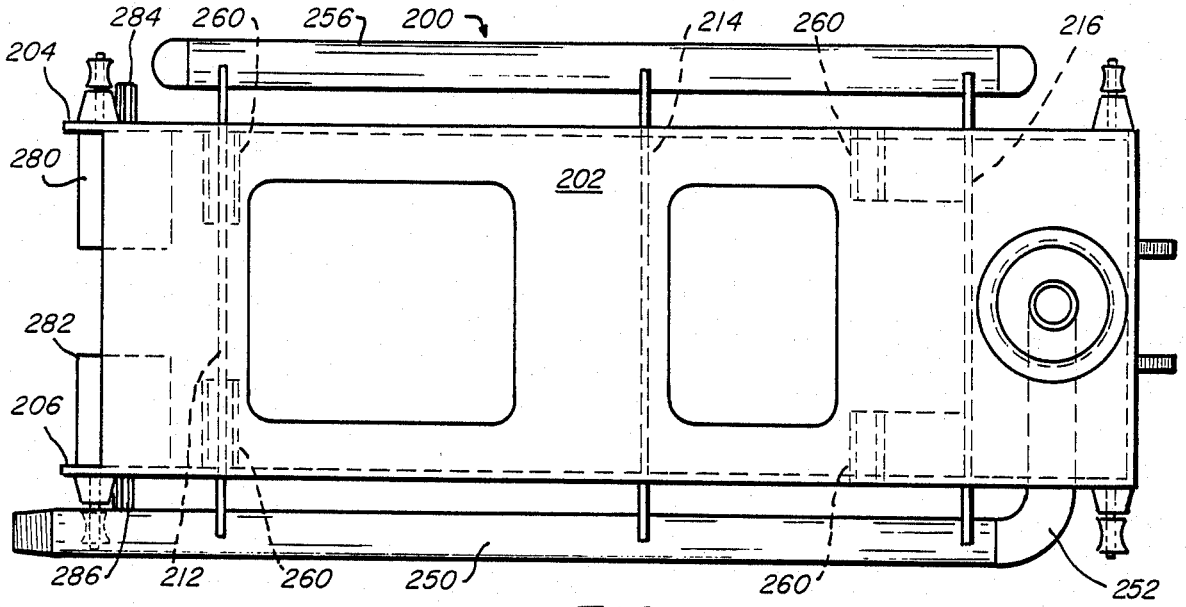
FIG. 4 is a top view of the open bottomed frame for the water washing robot.
Figure 5:
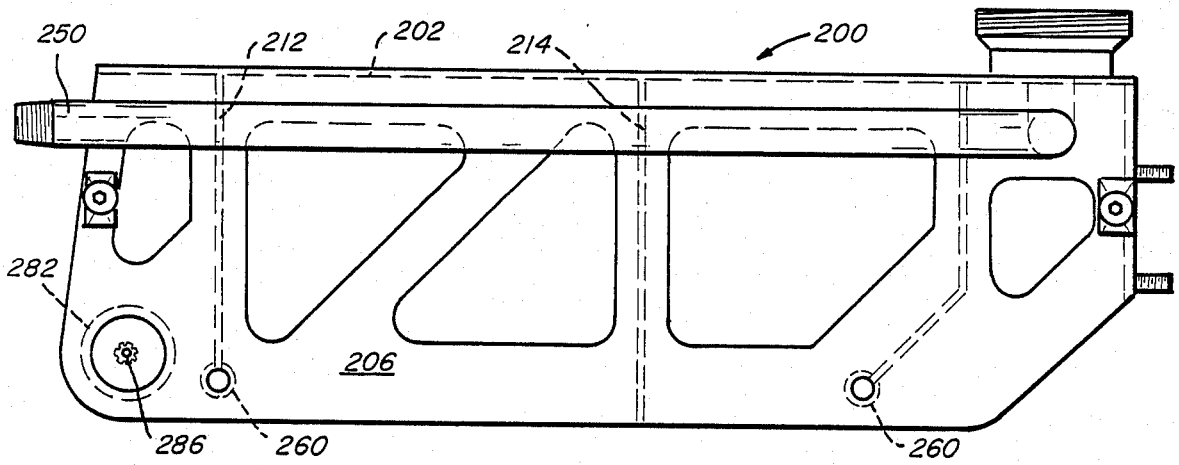
FIG. 5 is a side view of the frame shown in FIG. 4.

Turning now to FIG. 3, there is shown a combination scaffold/slide rail/wench assembly 800 for use in moving the water wash robot frame assembly through an entryway 12 into a tank 10 to be cleaned. The assembly 800 may comprise, for example, a first pair of adjustable support legs 802 and a second pair of adjustable support legs 804, each pair of legs being provided with cross braces 805 to adjust the spacing between the legs such that the idler pulleys 270 and 272 of the water washing robot frame assembly 200 can be seated on guides rails 810 and 812 supported by the legs 802 and 804. In similar fashion, a third pair of adjustable support legs 806 and a fourth pair of adjustable support legs 808 are assembled inside the storage tank 10. The spacing between the legs 802 and 804 and the spacing between the legs 806 and 808 is greater than the length of the water washing robot frame assembly 200. When the scaffolding defined by the adjustable legs 802–808 is assembled and the guide rails 810 and 812 have been positioned thereon, an appropriate wench support as an "A" brace 814 may be mounted on the guide rails 810–812 adjacent the entryway 12 and an adjustable pedestal brace 816 may be positioned adjacent the legs 802. Cross beam 818 is used to interconnect the "A" brace 814 with pedestal brace 816 and a wench 820 is slidably mounted on the cross beam 818. Cable 822 of the wench 820 interconnects with a spider 824 having couplings 826 depending therefrom, which can be looped around the water wash inlet pipe 250 and the handle pipe 256. The wench may then be activated by rotation of the handle 828 in order to raise or lower the spider 824 on the cable 822 as desired to thus raise or lower the water washing robot frame assembly 200.

OPERATION

When a storage tank 10 is to be cleaned, the portable power unit 400 is moved to a location adjacent the tank 10 and the individual components of the tank cleaning water washing robot are then moved into the tank through the entryway 12. Thus, the articulatable wash water jetting means 300, and each of the hydraulically powered robot articulation means 700 will be separately brought into the tank 10 through the entryway 12. Next, the scaffolding of the scaffold/slide rail/wench assembly 800 is put in place. In particular, the first pair of support legs 802 and the second pair of support legs 804 are properly positioned as are the third and fourth pairs of support legs 806 and 808 inside the storage tank 10. Guide rails 810 and 812 are mounted on the legs 802, 804, 816 and 818 and extend from outside the entryway 12 through the entryway 12 into the storage tank 10. Next, the "A" brace 814 is mounted on guide rails 810 and 812 outside of entryway 12 and the pedestal base 816 is positioned to interconnect by way of the cross brace 818. The wench 820 is then mounted on cross brace 818. The segment of the guide rails 810 and 812 between the legs 802 and 804 is removed, the water washing robot frame assembly the 200 is positioned beneath the wench 824 and the cable 822 is lowered so that the couplings 826 on the spider 824 may be interconnected with the wash water inlet pipe 250 and the handle pipe 256 and secured thereto. Thereafter, the wench handle 828 is turned in order to raise the water washing robot frame assembly 200 to a position above the position of the guide rails 810 and 812, after which the guide rails 810 and 812 are reinstalled. Next, the wench handle 828 is operated so as to lower the water washing robot frame assembly so that the idler rolls 270–272 will set on the guide rails 810 and 812. The couplings 826 of the spider 824 and the "A" brace 814 and the pedestal brace 816 are then disconnected and the water washing robot frame assembly 200 may be pushed through the entryway 12, into the inside of the tank 10.

"A" brace 814 is then moved inside the storage tank 10 as well as pedestal brace 816 and cross brace 818 where they are reassembled so that the wench 828 may be suspended therefrom. The couplings 826 of the spider 824 are again connected to the wash water inlet pipe 250 and the handle pipe 256, the thereafter the water washing robot frame assembly is lifted from the guide rails 810 and 812 so that they may be removed. The water washing robot frame assembly may then be lowered to the floor of the storage tank 10 for assembly with the hydraulic power robot articulation means 700 and the articulatable water washing jetting means 300.

The water supply hose 416 is then connected with the inlet to the high pressure water pump 410, and the water discharge hose 418 is interconnected between the discharge port for the high pressure water pump 410 and the wash water inlet pipe 250 of the water washing robot frame assembly 200. Hydraulic lines such as the hydraulic fluid supply hose 420 and hydraulic fluid return hose 422 are then interconnected between the hydraulic fluid reservoir 414 and the control panel for the assembled tank cleaning water washing robot 100. Also, the control unit hydraulic hose line 602 will be interconnected between the hydraulic control unit 600 and the water washing robot assembly 200. The high pressure water pump 410 can then be started in order to deliver water under pressure to the tank cleaning water washing robot 100 through the water supply hose 416 and the hydraulic motor for the positive displacement pump 220 can be actuated so that liquid accumulating at the bottom of the tank 10 can be pumped therefrom by the positive displacement pump 220 through the spent wash water discharge hose 240 for disposal at an appropriate location.

If the operator wants to move the nozzle 340 in a vertical plane, he can operate toggle switch 620 which, in turn, will activate three way toggle control valve 951 to cause hydraulic fluid to flow to the control elements for the three way control valve 977 to thereby permit the hydraulic motor 324 to be rotated in the desired direction (e.g. clockwise) in order to move the nozzle. The toggle switch 620 is returned to neutral when the nozzle has been moved to the desired location. In similar fashion, rotation of the nozzle 340 in a horizontal plane may be regulated by movement of the toggle switch 618 which is operatively interconnected with the three way toggle control valve 979 and hydraulic motor 314. Operation of the positive displacement pump is regulated by movement of the toggle switch 616.

Movement of the right catapillar tread 702 of the hydraulically powered robot articulation means 700 is controlled by toggle switch 612 and the left catapillar tread 702 is controlled by movement of the toggle switch 614.

If an operator 500 wishes to first wash down the sides of the tank 10, the articulatable wash water jetting means 300 can be rotated from side to side by the first swivel joint gear 312 and up and down by the second swivel joint gear 322 in order to jet water from the nozzle 340 against the sides of the tank 10 to clean the same. As water accumulates along the bottom of the tank 10 it will be pumped there from the positive displacement pump 220 in the manner described.

If in during the course of cleaning operation the filter 226 attached to the flanged scoop-shaped inlet member 224 should become clogged, the operator can reverse the direction of flow of the positive displacement pump 220 in order to clear the filler 226.

The tank cleaning water washing robot 100 can be moved from place to place about the tank 10 by actuation of the hydraulic motors controlling movement of the caterpillar treads 702. Thus, both treads can be operated in the same direction in order to move the water washing robot 100 in a forward direction or to move the water washing robot 100 in a reverse direction. The water washing robot 100 can be turned to the right or to the left by operating one of the caterpillar treads 702 in a forward direction and the other caterpillar tread 702 in a rearward direction.

When water washing operation is complete, the hydraulic lines are disconnected, withdrawn through the entryway 12 and the water washing robot 100 is again disassembled into its component parts, after disconnecting the hose 240 and the hose 418 so that the individual components comprising the water washing robot can be removed through the entry way 12.

Having thus described the invention what is claimed is:

1. A water washing robot comprising:

a frame having robot articulation means detachably mounted thereon for moving said frame, positive displacement water pump means carried by said frame, nozzled articulatable water washing means detachably mounted on said frame for spraying water on a surface to be cleaned, hydraulic power means operatively independently connected with said positive displacement water pump means, said robot articulation means and said articulatable water washing means for powering said pump means and articulating said frame and said water washing means, hydraulic control means independently operatively connected with said hydraulic power means for regulating the operation thereof, water supply means connected with said articulatable water washing means for delivering wash water thereto, and water disposal means connected with said positive displacement water pump means for disposing of waste water.

2. A water washing robot as in claim 1 wherein:

a. the robot articulation means comprises a pair of endless hydraulically powered articulation treads detachably mounted on each side of said frame.

3. A water washing robot as in claim 1 wherein:

a. the robot articulation means comprises a pair of endless hydraulically powered articulation treads detachably mounted on each side of said frame, and b. the nozzled articulatable water washing means includes water inlet means interconnectable with said water supply means, a horizontally rotatable elbow joint, a vertically rotatable elbow joint and a nozzled discharge pipe connected in series, and hydraulically powered motor means for rotating said elbow joints.

4. A water washing robot as in claim 1 wherein:

a. the robot articulation means comprises a pair of endless hydraulically powered articulation treads detachably mounted on each side of said frame, b. the nozzled articulatable water washing means includes water inlet means interconnectable with said water supply means, a horizontally rotatable elbow joint, a vertically rotatable elbow joint and a nozzled discharge pipe connected in series, and hydraulically powered motor means for rotating said elbow joints and c. the positive displacement water pump means comprises a reverse action positive displacement pump having a bottom port for normally receiving fluids to be pumped, a second rear axial port connected with said water disposal means for normally discharging fluids pumped by said positive displacement pump and a reverse action hydraulic motor operatively connected with said positive displacement pump for reversably powering said positive displacement pump.

5. A water washing robot comprising:

a. a frame, b. articulation means detachably mounted on said frame for moving said frame about a lateral surface to be cleaned, c. reverse action positive displacement water pump means carried by said frame, said water pump means having a bottom port for normally receiving fluids to be pumped by said water pump means and an axial rear port for normally discharging fluids pumped by said water pump means, d. hydraulic pump motor means carried by said frame and operatively connected with said positive displacement water pump means for reversably powering said pump, e. articulatable nozzled water-jetting means detachably mounted on said frame for spraying a surface to be cleaned, f. water supply means connected with said water-jetting means for delivering water under pressure thereto, g. first hydraulic motor means carried by said frame and operatively connected with said robot articulation means for moving the same, h. first hydraulic motor control means remotely, operatively hydraulically connected with said first hydraulic motor means for regulating movement of said robot articulation means, i. second hydraulic motor means carried by said water jetting means and operatively connected with said articulatable nozzle for moving the same, j. second hydraulic motor control means remotely, operatively hydraulically connected with said second hydraulic motor means for regulating movement of said articulatable nozzle, k. third reversible hydraulic pump motor means carried by said frame and operatively connected with said positive displacement water pump motor means for reversably powering said water pump means, and l. third hydraulic motor control means remotely hydraulically operatively connected with said third hydraulic pump motor means for controlling the pumping action of said positive displacement water pump means.

6. A water washing robot as in claim 5 wherein:

a. the robot articulation means comprises a pair of endless hydraulically powered articulation treads detachably mounted on each side of said frame.

7. A water washing robot as in claim 5 wherein:

a. the robot articulation means comprises a pair of endless hydraulically powered articulation treads detachably mounted on each side of said frame, and b. the reverse action positive displacement water pump means comprises a Moyno pump.

8. A water washing robot as in claim 5 wherein:

a. the robot articulation means comprises a pair of endless hydraulically powered articulation treads detachably mounted on each side of said frame, b. the reverse action positive displacement water pump means comprises a Moyno pump, and c. the nozzled articulatable water washing means includes water inlet means interconnectable with said water supply means, a horizontally rotatable elbow joint, a vertically rotatable elbow joint and a nozzled discharge pipe connected in series, and hydraulically powered motor means for rotating said elbow joints.

9. An exteriorly powered and remotely controllable water washing robot for washing the interior of an oil storage tank to be cleaned, said storage tank having an entryway adjacent the bottom thereof, said robot comprising:

a. a frame movable through said entryway into the inside of said tank, b. robot articulation means detachably mounted on said frame for movement about said tank bottom, c. reverse action positive displacement water pump means carried by said frame, said water pump means having a scoop-shaped bottom port for normally receiving fluids to be pumped by said water pump means and an axial rear port for normally discharging fluids pumped by said water pump means from said tank, d. first reversible hydraulic pump motor means carried by said frame and operatively connected with said positive displacement water pump means for reversibly powering said positive displacement water pump, e. first hydraulic motor control means remotely, hydraulically operatively connected with said first hydraulic motor means for controlling the pumping action of said positive displacement water pump means, f. filter means mounted on said scoop for excluding unwanted solids from said positive displacement water pump, g. articulatably nozzled water-jetting means detachably mounted on said frame for spraying a surface to be cleaned, h. water supply means outside said tank fluidly interconnected through said entryway with said water-jetting means for delivering water under pressure thereto, i. second hydraulic motor means carried by said frame and operatively connected with said robot articulation means for moving the same, j. second hydraulic motor control means remotely, hydraulically operatively connected with said second hydraulic motor means for regulating movement of said robot articulation means, k. third hydraulic motor means carried by said water jetting means and operatively connected with said articulatable nozzle for moving the same, l. third hydraulic motor control means remotely, hydraulically operatively connected with said third hydraulic motor means for regulating movement of said articulatable nozzle, m. water discharge means operatively connectable through said entryway with said positive displacement water pump for removing fluids discharged by said positive displacement water pump means.

10. A water washing robot as in claim 9 wherein:

a. the robot articulation means comprises a pair of endless hydraulically powered articulation treads detachably mounted on each side of said frame.

11. A water washing robot as in claim 5 wherein:

a. the robot articulation means comprises a pair of endless hydraulically powered articulation treads detachably mounted on each side of said frame, and b. the reverse action positive displacement water pump means comprises a Moyno pump.

12. A water washing robot as in claim 9 wherein:

a. the robot articulation means comprises a pair of endless hydraulically powered articulation treads detachably mounted on each side of said frame, b. the reverse action positive displacement water pump means comprises a Moyno pump, and c. the nozzled articulatable water washing means includes water inlet means interconnectable with said water supply means, a horizontally rotatable elbow joint, a vertically rotatable elbow joint and a nozzled discharge pipe connected in series, and hydraulically powered motor means for rotating said elbow joints.

13. An exteriorly powered and remotely controllable water washing robot useful for washing the interior of an oil storage tank to be cleaned, said tank having an entryway adjacent the bottom thereof, said robot comprising:

a. an open-bottomed frame having opposed side panels and a top panel interconnecting said side panels, said frame having a height and width such that it can be moved into said storage tank through said entryway in said tank, b. endless hydraulically powered robot articulation means detachably mountable on the outside of each of said side panels of said frame and insertable through said entryway in said tank, c. reverse action positive displacement water pump means mounted in said frame between said side panels, said water pump means having a scoop-terminated bottom port for normally receiving fluids to be pumped by said water pump means and an axial rear port for normally discharging fluids pumped by said water pump means from said tank, d. filter means mounted on the scoop of said bottom port for excluding unwanted solids from said positive displacement water pump means, e. nozzled, articulatable water-jetting means insertable through said entryway in said tank and detachably mountable on the top of said top panel of said frame for washing the inside surfaces of said tank, f. water supply means outside said tank in fluid communication with and connected through said entryway with said water-jetting means for delivering water under pressure thereto, g. first reversible hydraulic pump motor means carried by said frame and operatively connected with said positive displacement water pump means for reversibly powering said positive displacement water pump, h. first hydraulic motor control means remotely, hydraulically operatively connected with said first hydraulic motor means for controlling the pumping action of said positive displacement water pump means, i. second hydraulic motor means carried by said frame and operatively connected with said robot articulation means for moving the same, j. second hydraulic motor control means carried by said frame and operatively connected with said second hydraulic motor means for regulating movement of said robot articulation means, k. third hydraulic motor means carried by said frame and operatively connected with said water jetting means for moving the same, l. third hydraulic motor control means carried by said water jetting means and operatively connected with said third hydraulic motor means for regulating movement of said articulatable nozzle, m. hydraulic power means outside said tank hydraulically connected through said entryway with said first, second and third hydraulic motor means, for independently driving each of the same, n. hydraulic switch means insertable through said entryway and hydraulically operatively connected with said first, second and third hydraulic control means for regulating their hydraulic action, and o. water discharge means operatively connectable through said entryway with said positive displacement water pump for removing fluids discharged by said positive displacement water pump means.

14. A water washing robot as in claim 13 wherein:

a. the robot articulation means comprises a pair of endless hydraulically powered articulation treads detachably mounted on each side of said frame, and b. the reverse action positive displacement water pump means comprises a Moyno pump.

15. A water washing robot as in claim 13 wherein:

a. the robot articulation means comprises a pair of endless hydraulically powered articulation treads detachably mounted on each side of said frame, b. the reverse action positive displacement water pump means comprises a Moyno pump, and c. the nozzled articulatable water washing means includes water inlet means interconnectable with said water supply means, a horizontally rotatable elbow joint, a vertically rotatable elbow joint and a nozzled discharge pipe connected in series, and hydraulically powered moter means for rotating said elbow joints.

16. A water washing robot as in claim 13 wherein:

a. said frame includes a tubular water carrier mounted on a side thereon, and b. a bottom half of a mating joint mounted on the top panel of said frame and fluidly interconnected with said tubular water carrier.

17. A water washing robot as in claim 13 wherein:

a. said frame includes a tubular water carrier mounted on a side, and b. a bottom half of a mating joint mounted on the top panel of said frame and fluidly interconnected with said tubular water carrier, and wherein said nozzled, articulatable water jetting means includes:

aa. a water-jet frame supported on said top panel of said frame, bb. a water pipe mounted vertically in said water-jet frame, cc. a top half of a mating joint mounted on the bottom of said water pipe for connection with said bottom half of said mating joint on said frame, dd. a first horizontally rotatable elbow joint rotatably mounted on the top of said water pipe, ee. a second vertically rotatable elbow joint rotatably mounted on the free end of said first elbow joint, ff. a discharge conduit mounted on the free end of said second elbow joint, and gg. a nozzle mounted on the free end of said discharge conduit.

18. In combination, a water washing robot, a power supply trailer and a hydraulic control means useful for washing the interior of an oil storage tank to be cleaned, said tank having an entryway adjacent the bottom thereof, said robot comprising:

a. an open-bottomed frame having opposed side panels and a top panel interconnecting said side panels, said frame having a height and width such that it can be moved into said storage tank through said entryway in said tank, b. a pair of endless hydraulically powered articulation treads, each tread comprising an articulation frame detachably mountable on one of the side panels of said frame, an idler spool rotatably mounted on said articulation frame adjacent one end thereof, a first hydraulic drive spool rotatably mounted on said articulation frame adjacent the other end thereof, and an endless tractor tread eliptically mounted on said idler spool and said drive spool, said articulation tread being dimensioned for movement into said storage tank through said entryway, c. reverse action positive displacement water pump means mounted in said frame between said side panels, said positive displacement water pump means having a scoop-terminated bottom port for normally receiving fluids to be removed from said tank and an axial rear port for normally discharging fluids pumped by said positive displacement water pump means, d. first reversible hydraulic pump motor means carried by said frame and operatively connected with said positive displacement water pump means for reversibly powering said positive displacement water pump means, e. first hydraulic motor control means remotely, hydraulically operatively connected with said first hydraulic motor means for controlling the pumping action of said positive displacement water pump, f. filter means covering the mouth of said scoop for excluding unwanted solids, g. nozzled, articulatable water-jetting means dimensioned for movement into said storage tank through said entryway comprising:

g-1. a water-jet frame supportable on said top panel of said frame, g-2. a water pipe mounted vertically in said water-jet frame, g-3. a top half of a mating joint mounted on the bottom of said water pipe, g-4. a first horizontally rotatable elbow joint rotatably mounted on the top of said water pipe, g-5. a second vertically rotatable elbow joint rotatably mounted on the free end of said first elbow joint, g-6. a discharge conduit mounted on the free end of said second elbow joint, g-7. a nozzle mounted on the free end of said discharge conduit, g-8. first elbow joint hydraulic motor means carried by said water jet frame and operatively connected with said first rotatable elbow joint for rotating the same about its horizontal azxis, and g-9. second elbow joint hydraulic motor means carried by said water jet frame and operatively connected with said second rotatable elbow joint for rotataing the same about its vertical axis, h. tubular water supply means comprising an elongate water supply tube laterally mounted on a side panel of said frame above the robot articulation tread mounted thereon, a bottom half of a mating joint mounted on the top panel of said frame and fluidly interconnected with said water supply tube and said top half of said mating joint, i. second hydraulic motor means carried by said frame and operatively connected with said articulation means for the articulation thereof, j. second hydraulic motor control means remotely, hydraulically, operatively connected with said second hydraulic motor means for regulating movement of said robot articulation means, k. third hydraulic motor control means remotely, hydraulically, operatively connected with said first and second elbow joint hydraulic motor means for regulating the movement thereof, said power supply trailer comprising:

aa. a wheel mounted frame, bb. an internal combustion engine having a drive shaft mounted on said frame, cc. a water pump mounted on said frame, said water pump having an inlet port connectable with an external water supply source and an outlet port and said tubular water supply means and being operatively connected to the drive shaft of said internal combustion engine, dd. a hydraulic fluid pump mounted on said frame, ee. a hydraulic fluid reservoir mounted on said frame and fluidly interconnected with said hydraulic fluid pump, ff. first, second and third reels mounted on said frame, gg. a water hose insertable through said entryway into said tank carried by said first reel and interconnectable with said axial port of said positive displacement water pump, and hh. a first cable comprising hydraulic fluid supply lines insertable through said entryway into said tank, carried by said second reel and interconnectable between said hydraulic fluid reservoir and said first, second, and third, hydraulic motor means for independently driving the same, and ii. water discharge means operatively connected through said entryway with said axial port of said positive displacement water pump means said hydraulic control means comprising:

aaa. first, second, third, fourth and fifth three-way toggle switches, and bbb. a second cable insertable through said entryway into said tank, carried by said third reel and comprising sheathed first, second, third, fourth and fifth hydraulic control lines interconnectable with, respectively, said first, second, third fourth and fifth hydraulic control means and said first, second, third, fourth and fifth toggle switches of said hydraulic control means for controlling their hydraulic action.

* * * * *